US005657818A

United States Patent [19]

Böttcher et al.

[11] Patent Number: 5,657,818

[45] Date of Patent: Aug. 19, 1997

[54] PERMEABLE STRUCTURE

[75] Inventors: Jürgen Böttcher, Eckental-Eschenau; Rudolf Ganz, Lauf; Jürgen Heinrich, Selb; Otto Heinz, Neu-Isenburg; Rüdiger Herrmann, Münchberg; Jörg Hönerlage, Kieselbronn; Axel Reinhold, Selb; Heinrich Schelter, deceased, late of Selb, by Sybille Schelter, heiress; Matthias Simmerl, Leupoldsgrün, all of Germany

[73] Assignee: Hoechst CeramTec Aktiengesellschaft, Selb, Germany

[21] Appl. No.: 149,816

[22] Filed: Nov. 10, 1993

[30] Foreign Application Priority Data

Nov. 12, 1992 [DE] Germany ..... 42 38 190.8

[51] Int. Cl.[6] ..... F28F 3/08

[52] U.S. Cl. ..... 165/167; 165/166

[58] Field of Search ..... 165/167, 166

[56] References Cited

U.S. PATENT DOCUMENTS

| | | | |
|---|---|---|---|
| 4,612,982 | 9/1986 | Grehier et al. | 165/166 |
| 4,624,305 | 11/1986 | Rojey | 165/166 X |
| 4,934,453 | 6/1990 | Ganz et al. | 165/165 |
| 4,936,380 | 6/1990 | Niggemann | 165/167 |
| 5,016,707 | 5/1991 | Nguyen | 165/166 X |
| 5,063,995 | 11/1991 | Förster et al. | 165/166 |
| 5,099,915 | 3/1992 | Van Dyke | 165/166 X |
| 5,212,004 | 5/1993 | Boettcher et al. | 428/131 |

FOREIGN PATENT DOCUMENTS

| | | |
|---|---|---|
| 0 274 695 | 7/1988 | European Pat. Off. . |
| 0 274 694 | 7/1988 | European Pat. Off. . |
| 0 389 971 | 10/1990 | European Pat. Off. . |

*Primary Examiner*—John Rivell
*Assistant Examiner*—Christopher Atkinson
*Attorney, Agent, or Firm*—Foley & Lardner

[57] ABSTRACT

In the permeable structure, which is built up of sheets, continuous channels are arranged in rows and between the rows of channels are formed flow spaces which at opposite sides are bounded bit cover plates. In the flow spaces (4) at least two successive transverse bridges (6) are arranged on the same level, the transverse bridges (6) in at least half of the sheets having a different length (B) and the channels (1) extending essentially perpendicular to the flow spaces (4).

14 Claims, 5 Drawing Sheets

1
9
11
3
5
8
4
6a
6
2
7
10
B
A
W

PERMEABLE STRUCTURE

The invention relates to a permeable structure which is built up of sheets and in which continuous channels are arranged in rows and between the rows of channels are formed flow spaces which at opposite sides are bounded by cover plates.

In the description below sheets are to be taken to mean sheets of green ceramic, of metal such as alloys of copper, of steel, of aluminum or of plastic.

Permeable structures of the stated type that made of ceramic are disclosed in U.S. Pat. No. 5,212,004. These structures have rows of holes running parallel to one another between which are arranged channels which are provided in alternating sequence with uniform bridges arranged at regular intervals. When these structures are used as heat exchangers the heat exchange occurs via these bridges. An object of the present invention is to, inter alia, significantly improve the heat transfer and devise means for controlling the heat transfer.

The present invention achieves this object by a permeable structure of the type described in the introduction, in which there are arranged in the flow spaces at least two successive transverse bridges behind one another on the same level, the transverse bridges in at least half of the sheets having a different length and the channels extending essentially perpendicular to the flow spaces.

The advantages of the invention are essentially that varying the length of the bridges can be used to influence heat exchange and the turbulence of the medium in the flow spaces. The individual sheets for building up the structure can be cut from a sheet that can be made in an endless form, which allows the pattern of the individual sheets to be varied so that within the permeable structure at least from 3 to 20 different sheet patterns can be used for its construction. Furthermore, structures for a plurality of parallel-flowing media can be built up through configuration of the cover plates or by use of blank sheets. By offsetting the centers of the holes from the common axis of the row of holes, structures can be built up in which the channels formed by the holes obtain a stepped or helical surface.

The invention is illustrated below by diagrams which show only one possible embodiment.

Figure 1:
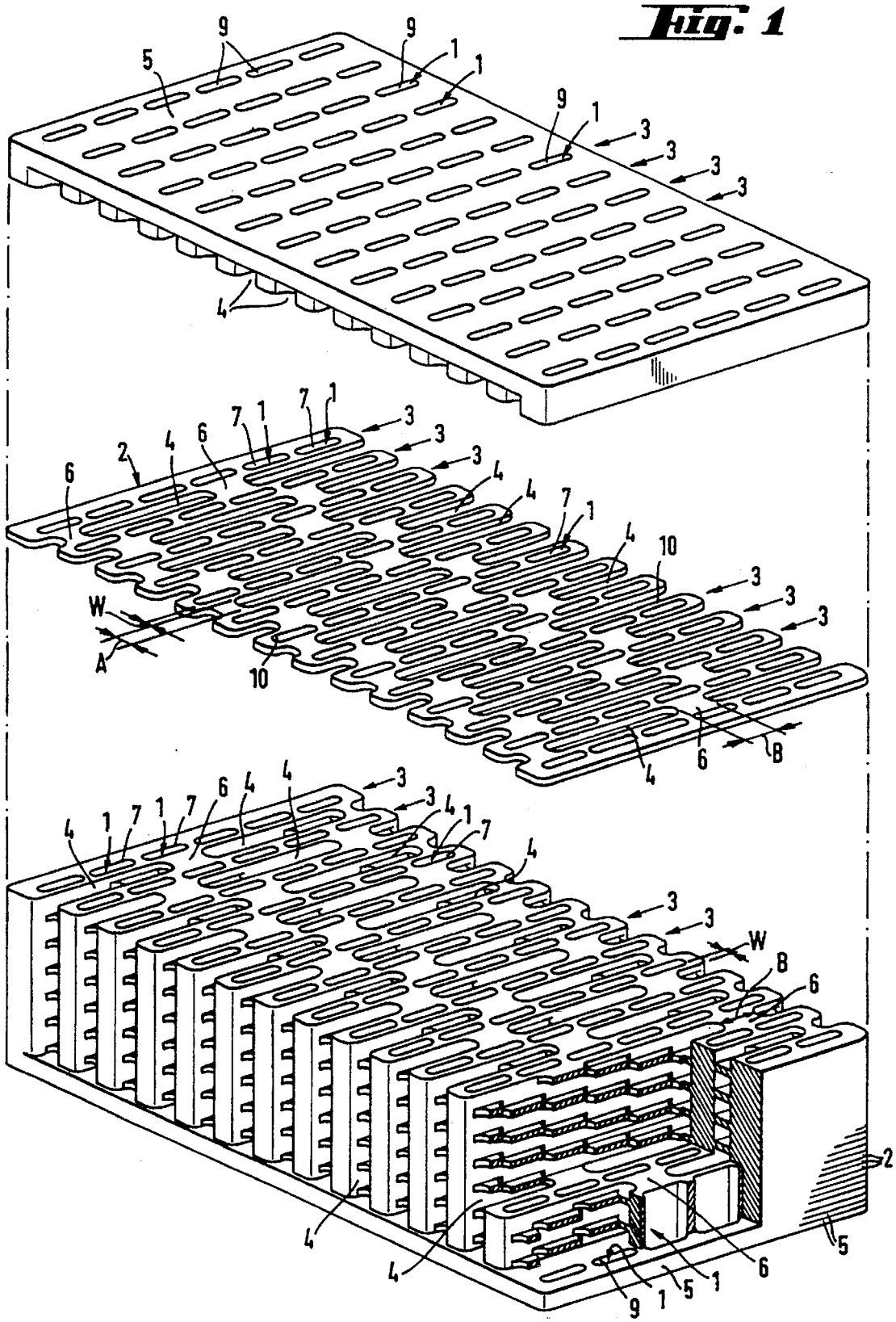
Figure 2:
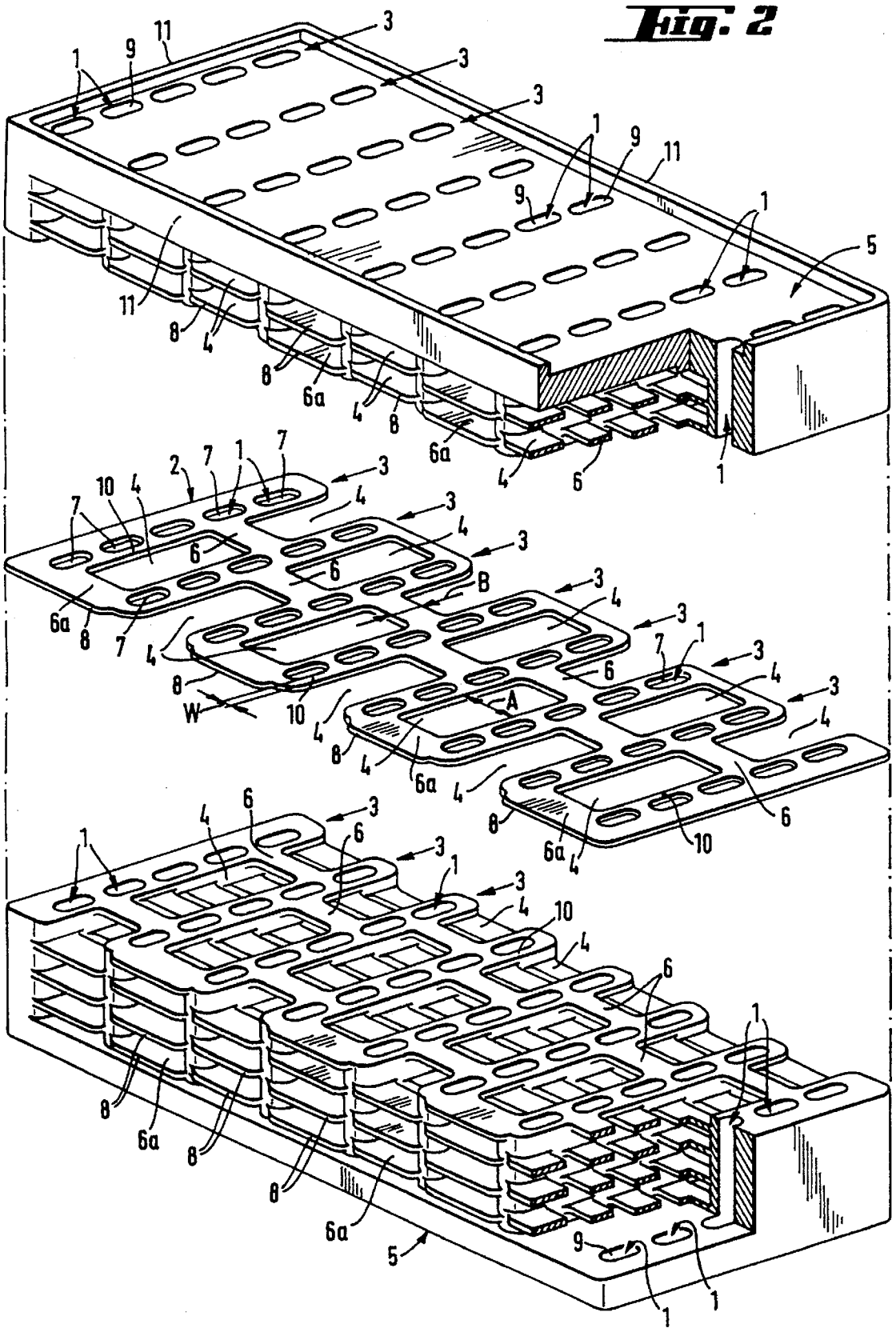
Figure 3:
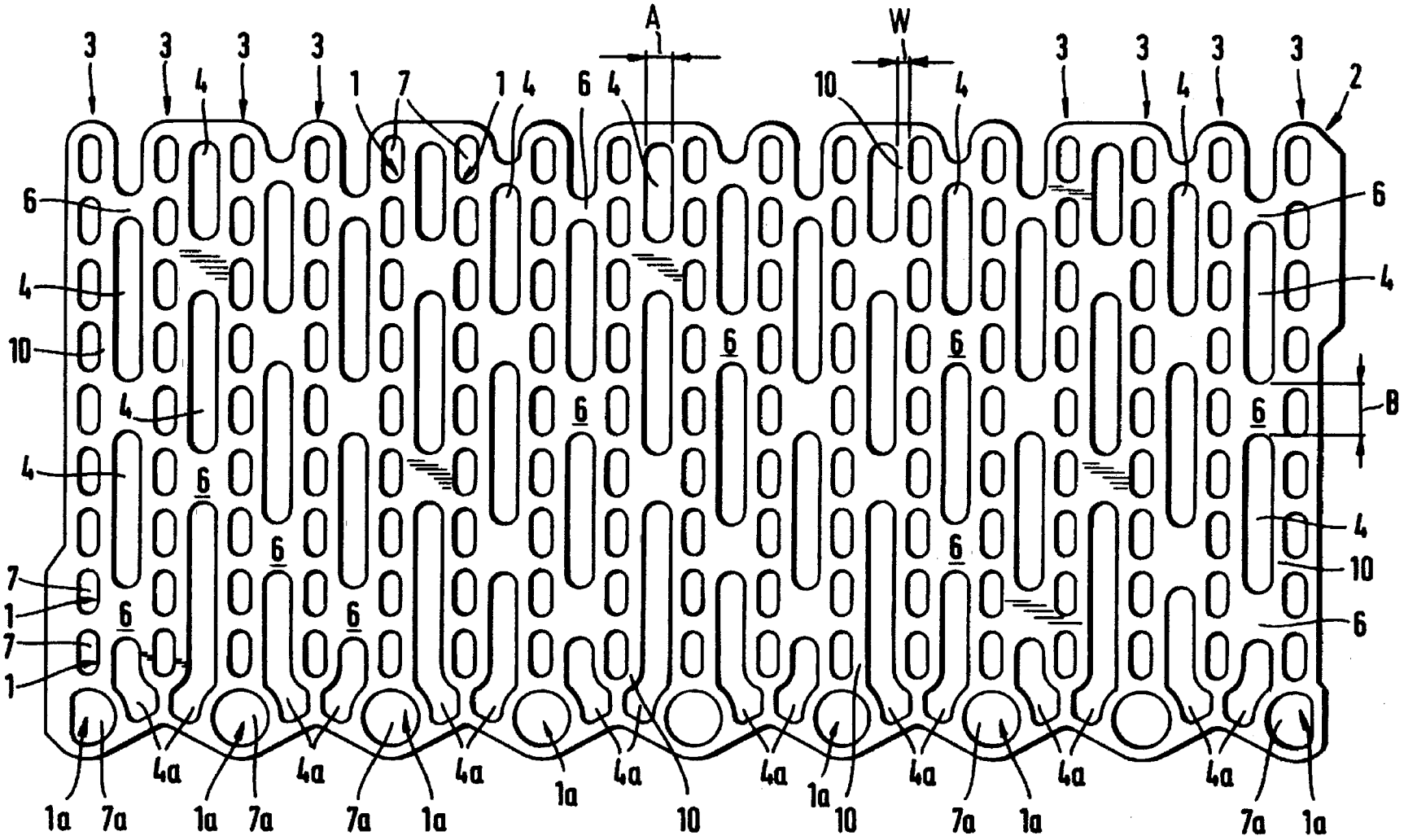
Figure 4:
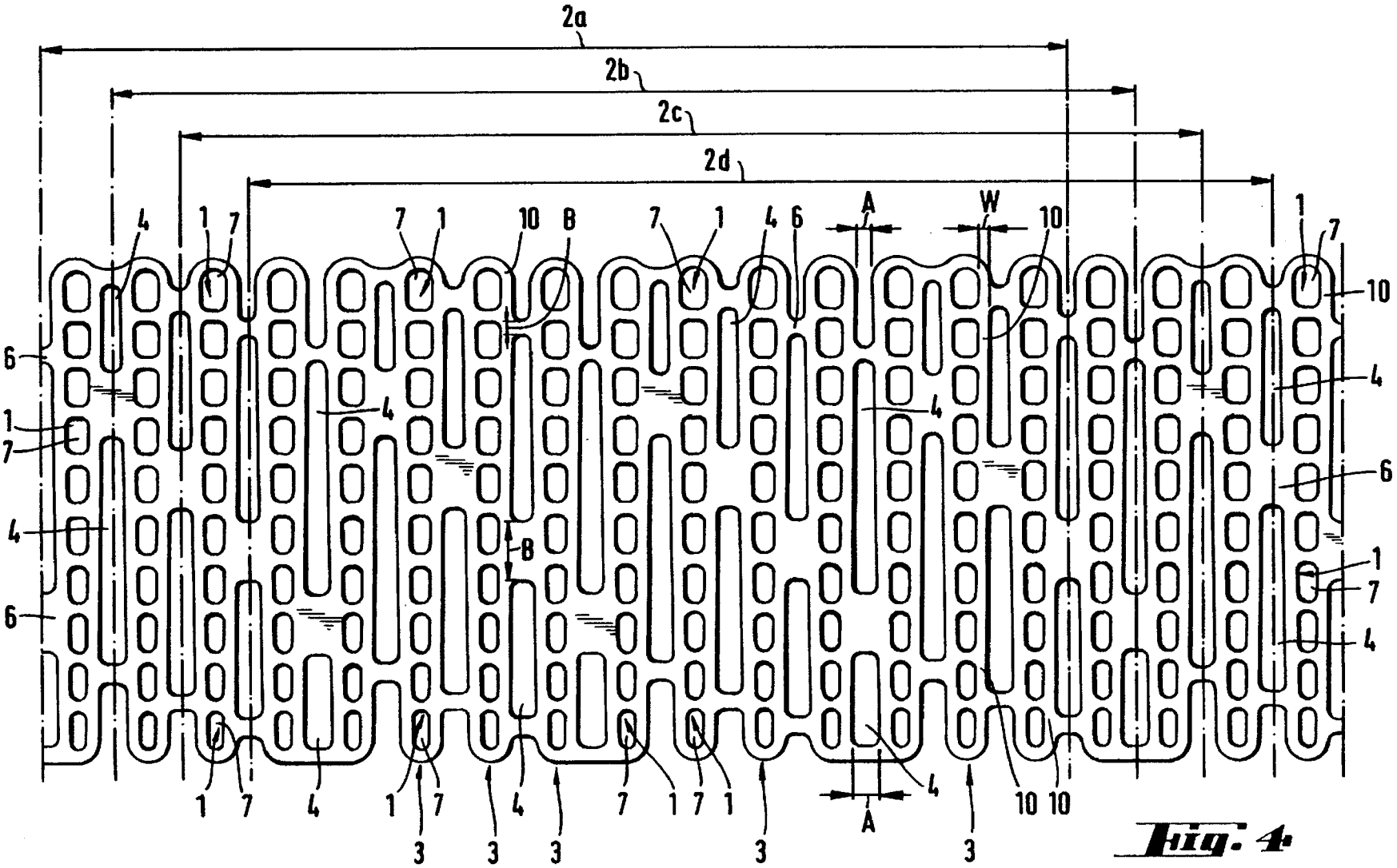
Figure 5:
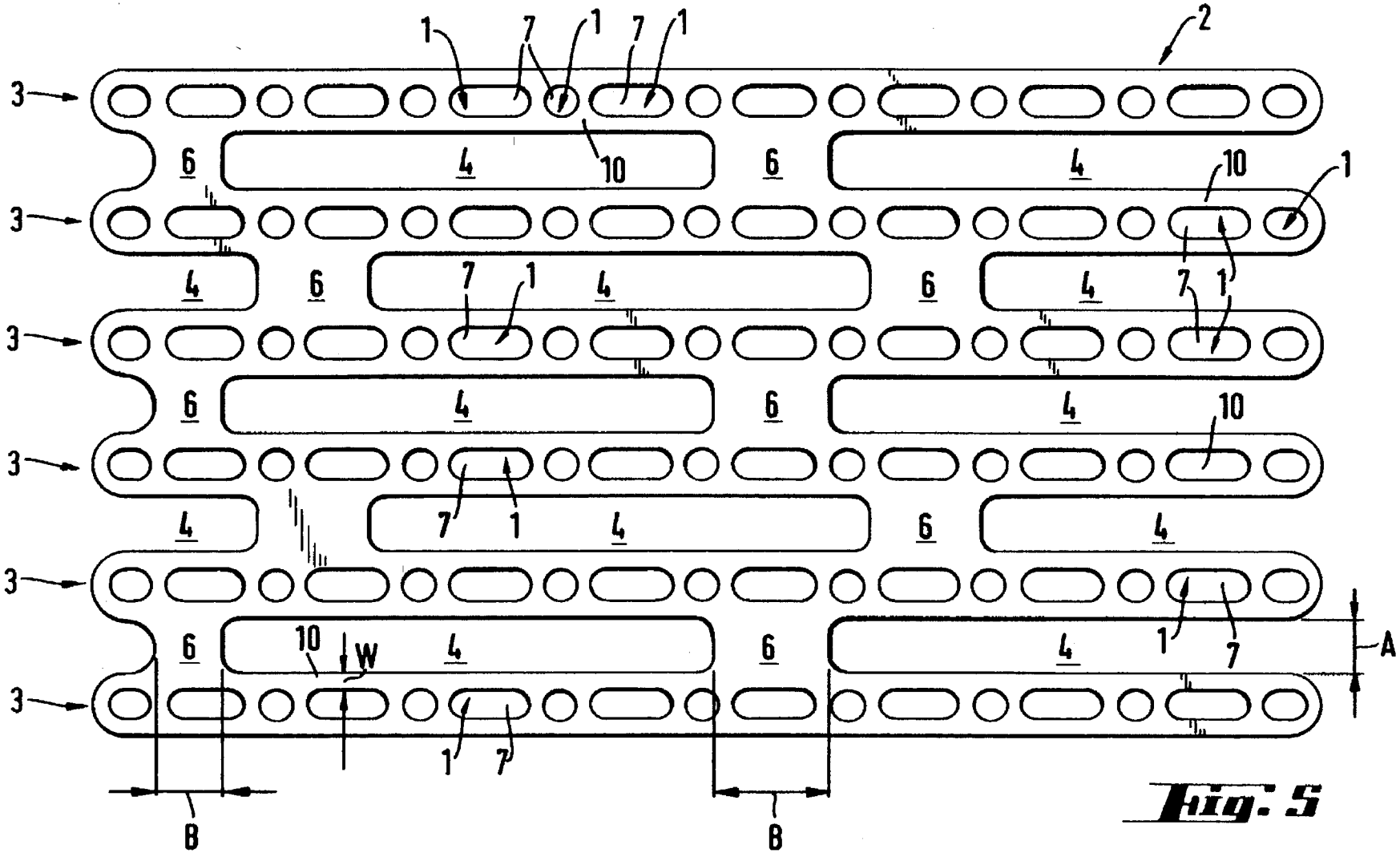

FIG. 1 shows the permeable structure in isometric projection partly cut away, FIG. 2 shows a variant of FIG. 1 in isometric projection partly cut away and FIGS. 3 to 5 show sheet variants for building up structures.

In the permeable structure, the continuous channels 1, which are formed by stacking of the sheets 2, are arranged in rows 3. Between the rows 3 of channels are formed flow spaces 4 which at opposite sides are bounded by cover plates 5 (covers). In the flow spaces 4 at least two transverse bridges 6 are arranged on the same level, the transverse bridges 6 in at least half of the sheets having a different length "B". The arrangement of the transverse bridges 6 in the flow spaces 4 can be chosen to correspond to the requirements of heat exchange and turbulence in the medium or media. The channels 1 extend essentially perpendicular to the flow spaces 4 and can run linearly and parallel to one another. By offsetting the holes 7 (hole midpoints) in the individual sheets 2 from the channel axes stepped or helical channel surfaces can be produced. Also, the channels 1 can be arranged in any desired form and desired arrangement to one another. The individual channels 1 can have a constant or variable cross-section over their length and/or with respect to one another (FIGS. 4and 5). The first channel 1*a* (hole 7*a*, FIG. 3) of a row 3 can have a larger cross-section than the remaining channels 1 which form the row 3 and be partly surrounded by the flow spaces 4*a*. The width "A" of the flow spaces 4 can be constant or vary in the direction of flow (FIG. 4). The flow spaces 4 can have, apart from the transverse bridges 6, further impediments of any desired shape, such as baffles etc. (not shown). The transverse bridges 6*a* at the edge can be provided with ribs 8 (FIG. 2). The channels 1 in a row 3 can be connected with one another and/or with neighboring rows 3 of channels through appropriate configuration of hollow spaces in the cover plates 5 which can be built up of as many sheets 2 as desired (not shown). Corresponding connections can also be created by the incorporation of special intermediate sheets or layers of sheets (not shown). The same applies to the flow spaces 4. The channels 1 and the flow spaces 4 can be built up of differently cut sheets (FIG. 4). The cutting lines for the sheets 2*a*, 2*b*, 2*c*, 2*d* can be seen in FIG. 4, which shows a section from a sheet strip that can be made in an endless form. The cover plates can have openings 9 or collecting channels (not shown) for the channels 1 and be provided with a fitted frame 11 which saves grinding the whole surface of the cover plates. The wall thicknesses "W" can be varied between the channels 1 and/or the flow spaces 4. Corners and edges can be rounded off. To control the heat transfer and to reduce the amount of material the transverse bridges 6 and the walls 10 between the rows 3 of channels and the flow spaces 4 can be provided with closed inaccessible hollow chambers or with hollow spaces which permit inflow or through-flow via one or a few openings (not shown).

Depending on the material, the sheets mat be joined together by lamination with subsequent firing, by soldering, welding, adhesive bonding or by mechanical means (for example using tie rods) with incorporation of seals in between. The sheets 2 with the openings can be produced by casting, sawing, milling, tuning, deep-drawing, embossing, laser cutting, stamping or liquid-jet cutting. The incorporation in the structure, between the sheets described, of sheets which essentially comprise only rows of holes without connecting ribs makes it possible for the geometric cross-section of the flow spaces to be widened to almost any desired extent. This is particularly advantageous in applications which require the pressure loss in the medium flowing through these flow spaces to be small, or in the case of dirty streams of media so as to avoid dirt accumulation in the structure. Larger cross-sections at the same time ensure easier access to the flow spaces for cleaning.

The structure of the invention enables in particular the production of heat exchangers, condensers, part-condensers, coolers, reactors, heat exchangers for heaters, especially condensing heaters and waste heat boilers for heat exchange in gas/gas, gas/liquid or liquid/liquid systems, and for burner designs with gaseous or liquid fuels.

What is claimed is:

1. A permeable structure comprising:

a plurality of superimposed sheets;

at least two first openings located in the sheets;

at least two continuous individual channels defined by said first openings when the sheets are superimposed, wherein the continuous channels are arranged in rows which are essentially parallel to one another;

at least two second openings located in the sheets;

flow spaces defined by said second openings, wherein the flow spaces are arranged in a direction perpendicular, to and in between, the rows of the continuous channels;

at least two successive transverse bridges arranged in the flow spaces and on the same level, wherein the length of at least one pair of successive transverse bridges in at least half of the sheets are different, and wherein the transverse bridges are arranged one after the other in longitudinal directions essentially parallel to the planes of the rows of the continuous channels.

2. A structure as claimed in claim 1, wherein the channels run linearly and parallel to one another.

3. A structure as claimed in claim 1, wherein the essential parallel channels include rows formed by offsetting the centers of the first opening from the common axis of the row of first openings whereby the channels formed by the first openers have a stepped or helical surface.

4. A structure as claimed in claim 1, wherein the individual channels have a constant cross-section over their length.

5. A structure as claimed in claim 1, wherein the individual channels have a variable cross-section over their length.

6. A structure as claimed in claim 1, wherein the cross-sections of the individual channels vary among themselves from channel to channel.

7. A structure as claimed in claim 1, wherein a first channel of a row has a larger cross-section than remaining channels which form the row and is partly surrounded by the flow spaces.

8. A structure as claimed in claim 1, wherein the flow spaces have a constant width (A).

9. A structure as claimed in claim 1, wherein the width of the flow spaces varies in the flow direction.

10. A structure as claimed in claim 1, wherein the transverse bridges at the edges are provided with ribs.

11. A structure as claimed in claim 1, wherein the channels and the flow spaces are built up of differently cut sheets from a pattern that can be made in an endless form.

12. A structure as claimed in claim 1, further comprising cover plates, wherein the flow spaces at opposite sides are bounded by the cover plates which have openings for the continuous channels.

13. A structure as claimed in claim 11, wherein the cover plates are provided with a fitted frame.

14. A method of producing a permeable structure according to claim 1, comprising:

(a) forming the first and second openings in the sheets by one or more of casting, sawing, milling, turning, deep-drawing, embossing, laser cutting, stamping or liquid-jet cutting; and (b) superimposing and joining the plurality of sheets by one or more of lamination with subsequent firing, soldering, welding, adhesive bonding or by mechanical means.

* * * * *